US007958855B2

(12) United States Patent
Nakamizo

(10) Patent No.: US 7,958,855 B2
(45) Date of Patent: Jun. 14, 2011

(54) AIR-COOLED V-TYPE COMBUSTION ENGINE

(75) Inventor: Keiichi Nakamizo, Maryville, MO (US)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 358 days.

(21) Appl. No.: 12/130,168

(22) Filed: May 30, 2008

(65) Prior Publication Data

US 2009/0293821 A1 Dec. 3, 2009

(51) Int. Cl.
*F01P 7/04* (2006.01)

(52) U.S. Cl. ..... 123/41.65

(58) Field of Classification Search ..... 123/198 R, 123/196 W, 41.65, 184.21, 195 P, 198 E, 123/41.7; 440/77, 76, 88, 88 A, 61 T, 49, 440/88 R; 277/637, 641; 164/271; 403/258; 74/595; 116/202

See application file for complete search history.

(56) References Cited

U.S. PATENT DOCUMENTS 5,445,547 A * 8/1995 Furukawa ..... 440/77
6,964,255 B2 * 11/2005 Shomura et al. ..... 123/198 E

FOREIGN PATENT DOCUMENTS

JP 61-106968 5/1986

* cited by examiner

*Primary Examiner* — Michael Cuff
*Assistant Examiner* — Keith Coleman

(57) ABSTRACT

A cooling fan assembly has an inner surface provided with a guide body for guiding a cooling air towards a first engine cylinder, positioned on a leading side with respect to the direction of rotation of the cooling fan assembly, and a second engine cylinder, positioned on a trailing side, after the cooling air has been separated. The guide body includes an upright wall protruding from the inner surface of the fan casing in an axial direction of the cooling fan assembly and extending radially outwardly and spirally from the inner surface of the fan casing as it progresses from the trailing side towards the leading side, and a ceiling wall connected with a projecting end of the upright wall and extending inside the spirality and operable to guide the cooling air inside the spirality of the upright wall towards the first engine cylinder.

12 Claims, 6 Drawing Sheets

AIR-COOLED V-TYPE COMBUSTION ENGINE

BACKGROUND OF THE INVENTION

1. Field of the Invention

The present invention relates to an air-cooled V-type combustion engine having two engine cylinders laid in a V-shape arrangement occupying respective locations that are spaced angularly from each other about an axis of rotation of the combustion engine.

2. Description of the Prior Art

It is well known that an air-cooled vertical V-twin combustion engine has long been used as a drive source for a work machine such as, for example, a brush cutting machine. This known air-cooled V-twin combustion engine has a cooling air passage defined in a fan casing, through which a cooling air induced by a cooling fan assembly flows to cool the two engine cylinders.

It has, however, been found that since the cooling air, before it is used to cool the engine cylinders, flows radially outwardly and slantwise from a trailing side towards a leading side, or forwardly, with respect to the direction of rotation of the cooling fan assembly, one of the two engine cylinders, which is positioned on the leading side with respect to the direction of rotation, tends to be cooled with an insufficient amount of cooling air although the other of the two engine cylinders, which is positioned on the trailing side with respect to the direction of rotation of the cooling fan assembly is cooled sufficiently. This leads to a difference in temperature between the two engine cylinders, which in turn results in a difference in combustion condition occurring in those two engine cylinders, and, therefore, disadvantages and inconveniences tend to occur in connection with thermal efficiency and removal of obnoxious components of the exhaust gases.

In view of the above, the Japanese Laid-open Patent Publication No. 61-106968, first published May 24, 1986, has suggested an air-cooled V-twin combustion engine system, in which two spiral guide walls for separating and guiding the cooling air, induced by the cooling fan assembly, towards the two engine cylinders, respectively, are formed in an inner surface of the fan casing so as to protrude in a direction parallel to the axis of rotation of the cooling fan assembly.

It has, however, been found that in the prior art combustion engine system discussed above, the cooling air tends to leak in a direction radially of the cooling fan assembly from a free end of the guide walls protruding in a direction parallel to the axis of rotation of the cooling fan assembly, it is not easy to enable the cooling air to be supplied towards the two engine cylinders in a desired proportion.

SUMMARY OF THE INVENTION

In view of the foregoing, the present invention has for its primary object to provide an air-cooled V-type combustion engine, in which the cooling air can be supplied towards the engine cylinders in a desired proportion to accomplish the cooling of the engine cylinders efficiently.

In order to accomplish the foregoing object, the present invention provides an air-cooled V-type combustion engine, which includes at least first and second engine cylinders positioned on leading and trailing sides with respect to a direction of rotation of a cooling fan assembly, respectively, a fan casing accommodating therein the cooling fan assembly that is drivingly coupled with a rotary shaft of the combustion engine and operable to induce a cooling air for cooling the first and second combustion engine, and a guide body positioned on an inner surface of the fan casing for dividing the cooling air into separate cooling air streams to cool the first and second engine cylinders, respectively. The guide body referred to above in turn includes an upright wall protruding in a direction parallel to an axis of rotation of the fan assembly and extending radially outwardly and spirally from a trailing side towards a leading side with respect to the direction of rotation of the cooling fan assembly, and a ceiling wall connected with a projecting end of the upright wall and extending spirally inwardly so as to guide the cooling air, then flowing inwardly of the spirally extending upright wall, towards the first engine cylinder.

According to the present invention, the flow of a portion of the cooling air induced by the cooling fan assembly is regulated by the upright wall, which extends radially outwardly and spirally in a direction forwardly of rotation of the cooling fan assembly, from flowing in a direction radially of the cooling fan assembly and, also, by the ceiling wall from flowing in a direction conforming to the axial direction of the cooling fan assembly, and is so directed as to travel exteriorly around the first engine cylinder to cool the latter while being guided by a spiral inner surface of the upright wall and an axial inner surface of the ceiling wall. In this way, while an undesirable leakage of the cooling air is suppressed by the upright wall and the ceiling wall, a required amount of cooling air can be supplied to the first engine cylinder, which tends to be cooled with an insufficient amount of cooling air since the first engine cylinder is positioned on the leading side with respect to the direction of rotation of the cooling fan.

On the other hand, another portion of the cooling air can be guided by the fan casing so as to travel exteriorly around the second engine cylinder to cool the latter, after having flown outside the guide body. Accordingly, by suitably selecting the size and the location of the guide body, it is possible to supply the cooling air in a desired proportion to thereby cool the first and second engine cylinders can be cooled effectively.

The axial position of the ceiling wall referred to above is preferably offset at a trailing side with respect to a direction of rotation of the cooling fan assembly closer to the fan casing rather than at the leading side thereof, that is, axially outwardly of the axial direction. In this case, since the ceiling wall is held at a small distance from the fan casing on the trailing side of the guide body with respect to the direction of rotation (or, at a high level in the case of the vertical combustion engine), a sufficient amount of cooling air can be supplied so as to travel exteriorly around the second engine cylinder to cool the latter after having passed along an outer surface of the ceiling wall, and since the ceiling wall is held at great distance from the fan casing on the leading side of the guide body with respect to the direction of rotation (or, at a low level in the case of the vertical combustion engine), a sufficient amount of cooling air can be guided into an air guide passage defined inside the guide body and then supplied so as to travel exteriorly around the first engine cylinder to cool the latter.

Accordingly, with a simplified structure designed to change the height of the ceiling wall in a direction conforming to the direction of rotation, a sufficient amount of the cooling air can be secured for both of the first and second engine cylinders.

The ceiling wall has a radial inner edge at a trailing portion thereof and this radial inner edge is preferably set to an axial position aligned with an axially intermediate point of rotary vanes of the cooling fan assembly. It is to be noted that the intermediate point referred to above is to be understood as containing an intermediate point corresponding to one half of the height h of each of the rotary vanes and a neighboring portion of the respective rotary vane encompassed by ±0.1 h in the axial direction C from this intermediate point. This construction is particularly advantageous in that since at the trailing portion of the ceiling wall, the cooling air induced in the manner described hereinbefore can be substantially equally divided into two streams, which are subsequently supplied so as to travel exteriorly around the first and second engine cylinders to cool them, the amount of the cooling air to be supplied towards the first and second engine cylinders can be properly distributed.

In a preferred embodiment of the present invention, the cooling fan assembly may include intermediate connecting plates each connecting the neighboring rotary vanes together in a circumferential direction. In this case, the radial inner edge of the trailing portion of the ceiling wall is preferably set to the substantially same axial position as that of the intermediate connecting plates.

According to this preferred feature, the cooling air can be induced by the cooling fan assembly during the rotation of the latter in the form as separated by the intermediate connecting plates in two streams, and at the training side of the ceiling wall, one of the streams of cooling air, which is induced so as to flow in a region axially inwardly of the intermediate connecting plates, can flow towards the second engine cylinder without being regulated by the upright wall and the ceiling wall, while the other of the streams induced axially outwardly of the intermediate connecting plates can be guided towards the first engine cylinder after having been regulated by the upright wall and the ceiling wall. Therefore, it is possible to minimize the cooling air from being ruffled by the ceiling wall and the sufficient amount of cooling air to be supplied towards the engine cylinders can be secured advantageously.

The ceiling wall referred to above preferably include a first flat wall area forming the trailing portion thereof, a second flat wall area forming the leading portion, and an inclined wall area connecting the first and second flat wall areas together. This preferred design of the ceiling wall is advantageous in that the amount of cooling air to be supplied towards the first and second engine cylinders can be properly distributed, while permitting the use of the ceiling wall of a simplified construction.

Each of the first and second flat wall areas referred to above may extend in, for example, a direction substantially perpendicular to an axial direction of the cooling fan assembly.

In another preferred embodiment of the present invention, the ceiling wall has a radial inner edge at the leading portion thereof, which edge is preferably held in proximity of an axial inner end portion of the cooling fan assembly. This is particularly advantageous in that since at the leading portion of the ceiling wall, a substantially entire amount of the cooling air can be guided into the air guide passage defined inside the guide body so as to travel exteriorly around the first engine cylinder, a required amount of cooling air to be supplied towards the first engine cylinder, which tends to be cooled with an insufficient amount of cooling air, can easily be secured.

In a further preferred embodiment of the present invention, the ceiling wall has a radial inner edge which is preferably held in proximity of a radial outer edge of the cooling fan assembly. This is particularly advantageous in that since while the leakage of the cooling air induced by the cooling fan assembly is suppressed, the cooling air can be supplied into the air guide passage defined inside the guide body and, therefore, the cooling air can be efficiently supplied towards the first engine cylinder. In such case, the radial inner edge of the ceiling wall and the radial outer edge of the cooling fan assembly may be spaced by a radial gap of 1 to 2 mm.

The upright wall referred to above preferably extend from a trailing side of a longitudinal axis of the second engine cylinder with respect to the direction of rotation to a position closer to a longitudinal axis of the first engine cylinder than to a position intermediate between the first and second engine cylinders in a direction conforming to the direction of rotation. By so doing, the cooling air can be smoothly guided along the upright wall towards the first engine cylinder.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Figure 1:
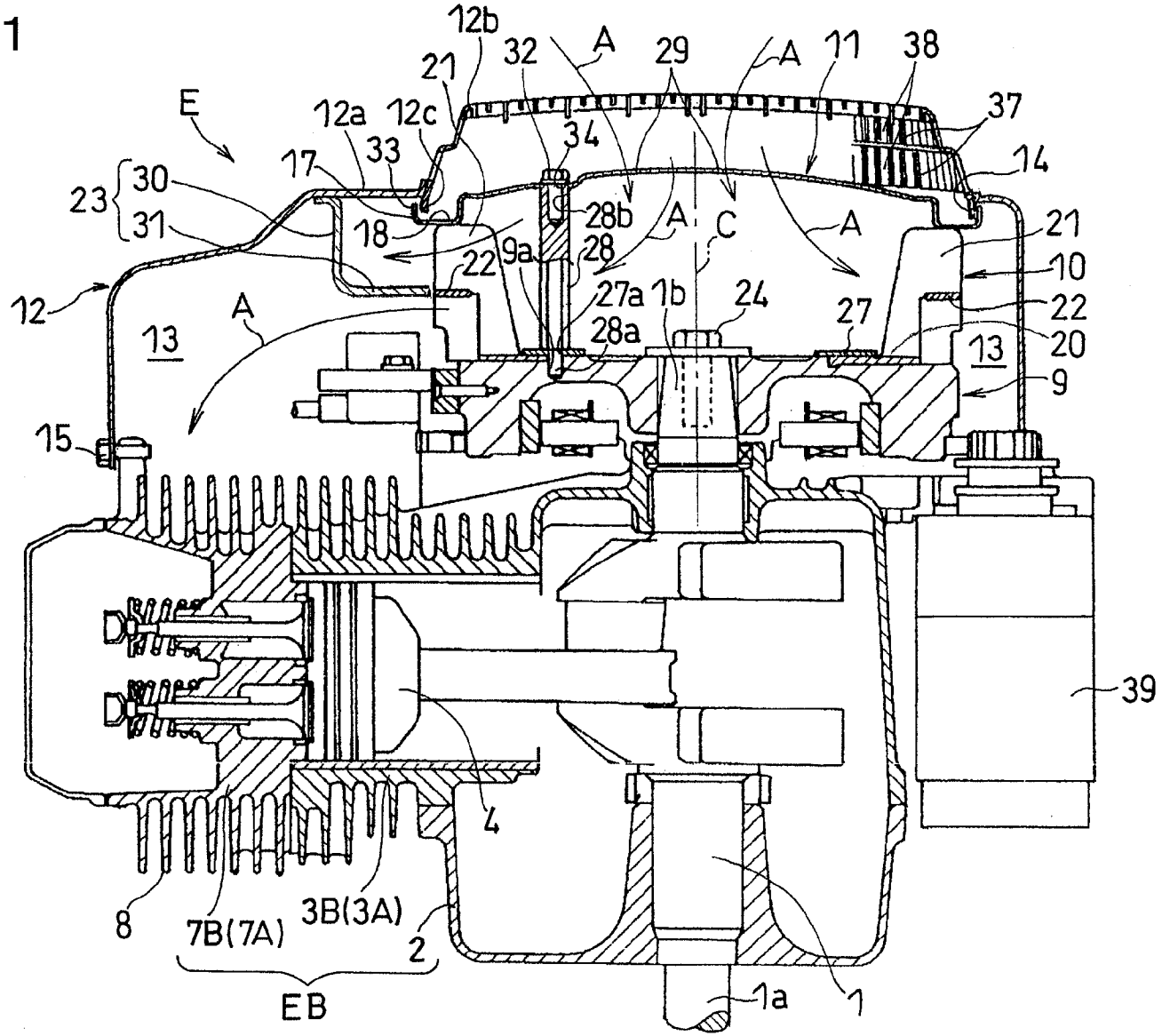
FIG. 1 is a longitudinal sectional view showing an air-cooled V-type combustion engine according to a first preferred embodiment of the present invention.

Hereinafter, a preferred embodiment of the present invention will be described in detail with reference to the accompanying drawings. Specifically, FIG. 1 illustrates an air-cooled V-type combustion engine E according to a first preferred embodiment of the present invention in a longitudinal sectional representation. The V-type combustion engine, which is shown in the accompanying drawings and is referred to in the following description for the purpose of illustration of the present invention, is in the form of an air-cooled vertical V-twin combustion engine and of a type generally used in a brush cutting machine, which is one of work machines to which the present invention can be applied.

Figure 2:
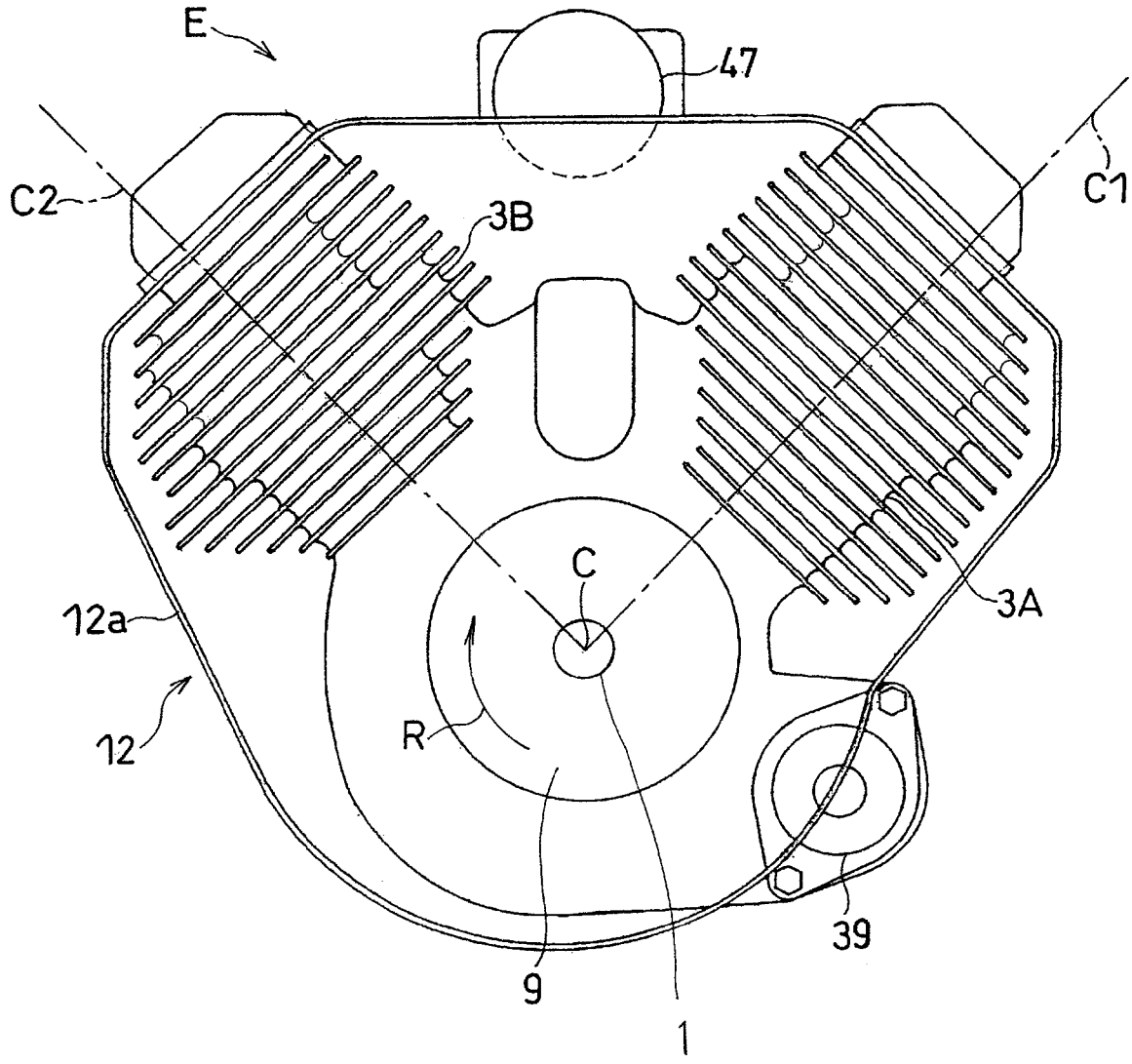
FIG. 2 is a schematic top plan view showing the air-cooled V-type combustion engine shown in FIG. 1.

As shown in a top plan view in FIG. 2, the air-cooled V-type combustion engine E includes first and second engine cylinders 3A and 3B laid in a V-shape arrangement with their respective longitudinal axes C1 and C2 spaced substantially 90° relative to each other about an axis of rotation C of a crankshaft 1 of the combustion engine E and can be started by a starter motor 39 in any known manner. Assuming that the crankshaft 1 rotates in a clockwise direction R as viewed in FIG. 2, the first engine cylinder 3A and the second engine cylinder 3B are positioned on leading and trailing sides with respect to the direction of rotation R, respectively. A carburetor 47 and an air cleaner (not shown) are arranged in a V-shaped space delimited between the first and second engine cylinders 3A and 3B.

The crankshaft 1, which is a rotary shaft of the combustion engine E shown in FIG. 1, extends substantially vertically through the interior of a crankcase 2 and reciprocating pistons 4 are drivingly coupled with this crankshaft 1 for movement within the respective engine cylinders 3A and 3B. The first and second engine cylinders 3A and 3B have respective cylinder heads 7A and 7B mounted thereon, and the first and second engine cylinders 3A and 3B and the cylinder heads 7A and 7B are formed integrally with respective multiplicities of heat radiating fins 8.

The crankcase 2, the first and second engine cylinders 3A and 3B and the cylinder heads 7A and 7B, all referred to hereinabove, altogether form an engine body EB. The crankshaft 1 has lower and upper ends 1*a* and 1*b* opposite to each other and protruding outwardly downwardly and upwardly from the crankcase, respectively, the lower end 1*a* of the crankshaft 1 being used as a drive output shaft. In the illustrated embodiment, in which the combustion engine E is used in, for example, the brush cutting machine, the lower end 1*a* of the crankshaft 1 is drivingly coupled with a cutter blade (not shown) through, for example, an electromagnetic clutch (also not shown).

On the upper end 1*b* of the crankshaft 1 is mounted a flywheel 9 including a permanent magnet for an engine ignition device for rotation together with the crankshaft 1. On the flywheel 9 is mounted a cooling fan assembly 10 for inducing a cooling air A during rotation of the crankshaft 1 and, hence, the flywheel 9. A dust preventive screen member 11 for covering a suction side (an upper region of the drawing), which lies axially outwardly, is fitted to the cooling fan assembly 10 through a plurality of, for example, three, support pillars 28, which may be in the form of a hexagonal bolt extending axially from the cooling fan assembly 10.

The screen member 11 is prepared from, for example, a thin metallic plate by the use of any known press work and has a major portion thereof, excluding an outer peripheral portion thereof, which is upwardly convexed as viewed in FIG. 1. That major portion of the screen member 11, which is upwardly convexed, are perforated to have a multiplicity of air intake holes 29 of a size sufficient to prevent grass chips, mixed in the cooling air A, form entering across the perforations 29.

A fan casing 12 accommodating therein the fan assembly 10 is made of a metallic material and includes a casing body 12*a* covering the cooling fan assembly 10, a covering 12*b* for covering a region axially outwardly of the screen member 11 and an annular protuberance 12*c* protruding axially downwardly from the covering 12*b*. The casing body 12*a* is fixedly mounted on the engine body EB by means of a plurality of set bolts 15 so as to define interiorly a cooling air passage 13 through which the cooling air A induced by the cooling fan assembly 10 can be guided towards the engine cylinders 3A and 3B, the cylinder heads 7A and 7B and the heat radiating fins 8 and into the crankcase 2.

The covering 12*b* is, after having been engaged with an inner peripheral surface of a round air intake opening 14 defined in the casing body 12*a*, connected rigidly with the casing body 12*a* by means of any suitable method such as, for example, a welding technique so as to cover the air intake opening 14. The covering 12*b* has a peripheral wall and a top wall, both of which are formed with respective pluralities of air intake slits 38 defined among pluralities of grids 37 for passage of the cooling air A towards the cooling fan assembly 10. The covering 12*b* has an open end (lower end) protruding inwardly into the casing body 12*a* to thereby form the annular protuberance 12*c* referred to hereinbefore.

The screen member 11 has an outer peripheral portion formed with a cutter 17 which extends along the axial direction of the crankshaft 1 in a direction close towards the fan casing 12 (i.e., in a direction upwardly as viewed in FIG. 1), and a downwardly depressed annular recess 18 is formed at a location radially inwardly of the cutter 17. In the illustrated instance, the cutter 17 forms an outer peripheral wall of the annular recess 18, and a plurality of circumferentially intermittently arranged cutting teeth 33 are formed in a free edge of the cutter 17. The annular protuberance 12*c* referred to previously protrudes into the annular recess 18 and is held radially inwardly of the cutter 17.

The annular recess 18 including the cutter 17 and the annular protuberance 12*c* engaged in the annular recess 18 are so designed and so defined relative to each other that relatively long chips of lawn and/or grass mixed in the cooling air A and subsequently entering through the air intake opening 14 by way of the air intake slits 38 in the covering 12*b* can be finely cut by the cutting teeth of the cutter 17 as they pass between the cutter 17 and the fan casing 12 through the annular recess 18. Accordingly, it is possible to avoid a possible clogging of the lawn and/or grass chips in between the neighboring heat radiating fins 8 in the engine cylinders 3A and 3B and the cylinder heads 7A and 7B.

The casing body 12*a* of the fan casing 12 has an inner surface fitted with a guide body 23 in the form of a thin metallic plate by means of a spot welding technique. This guide body 23 is of one-piece construction made up of an upright wall 30, which protrudes inwardly from an inner surface of the casing body 12*a* in a direction axially of the cooling fan assembly 10, that is, in a direction substantially parallel to the axis of rotation C of the crankshaft 1, and a ceiling wall 21 integral with a projecting end of the upright wall 30 remote from the fan casing 12 and extending spirally inwardly of the upright wall 30. The details of this guide body 23 will be described later.

Figure 3:
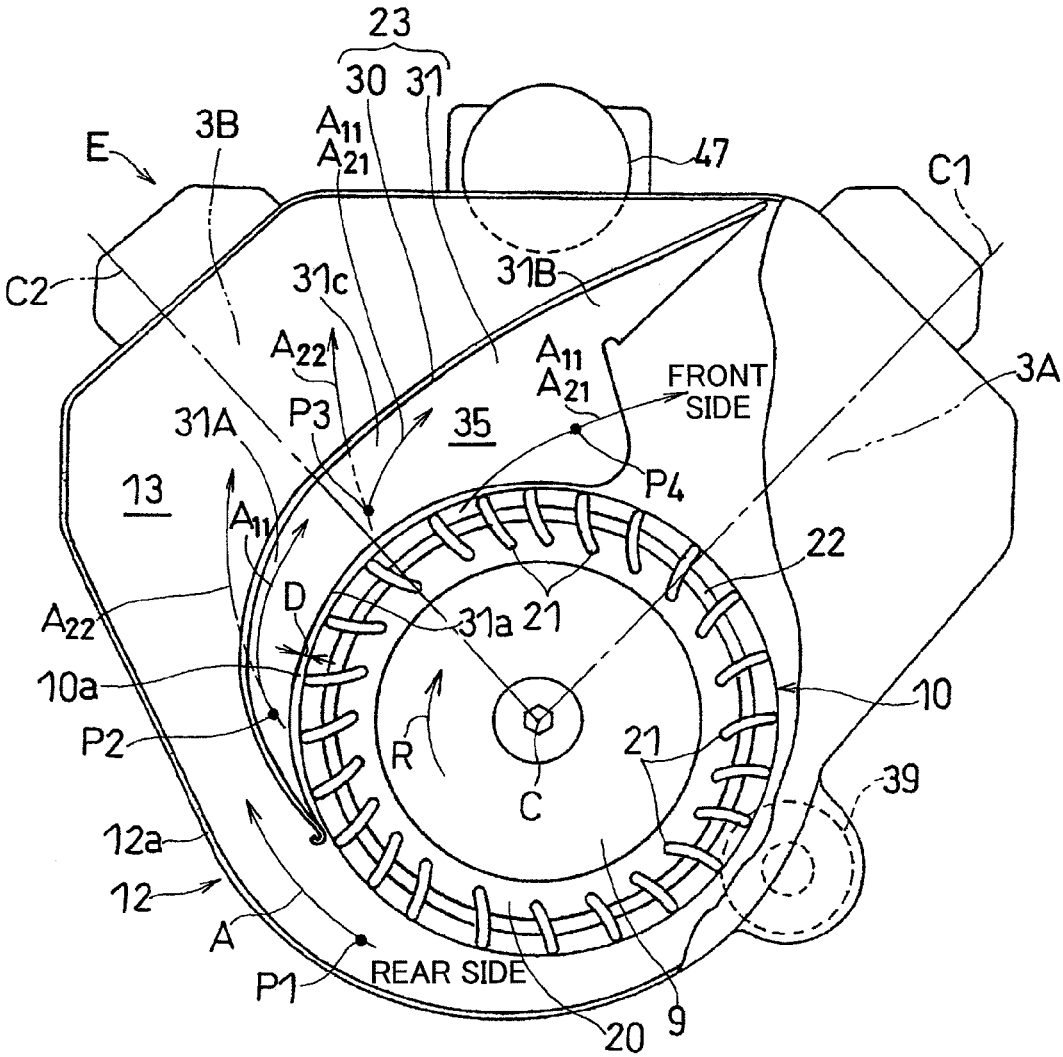
FIG. 3 is a schematic top plan with a portion broken away, showing the air-cooled V-type combustion engine shown in FIG. 1.
Figure 4:
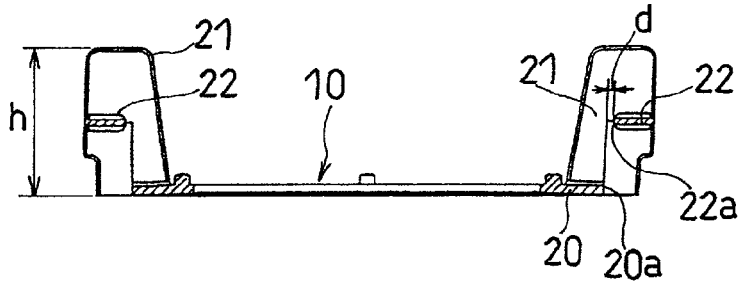
FIG. 4 is a schematic longitudinal sectional view, showing a cooling fan assembly used in the air-cooled V-type combustion engine shown in FIG. 1.

FIG. 3 illustrates a top plan view of the V-type combustion engine E with a portion thereof broken away and FIG. 4 illustrates a longitudinal sectional view of the cooling fan assembly 10. The cooling fan assembly 10 shown in FIG. 10 is made of, for example, a high strength resinous material such as, for example, a polyamide resin or a glass fiber reinforced resin and is of one-piece construction including an annular base plate 20 and a plurality of rotary vanes 21 formed integrally with the annular base plate 20 so as to protrude upwardly from the annular base plate 20. The rotary vanes 21, each in the form of a generally rectangular curved plate, are spaced an equal distance from each other in a direction circumferentially of the annular base plate 20 with each neighboring vanes 21 connected with each other by means of an intermediate connecting plate 22.

The intermediate connecting plates 22 are provided at a location aligned with respective portions of the rotary vanes 21 substantially intermediate of the axial length thereof and serve to avoid a possible deformation of the rotary vanes 21, which would otherwise occur by the effect of a centrifugal force during the rotation of the cooling fan assembly 10. It is to be noted that the intermediate portion of each of the rotary vanes 21 referred to above is to be understood as containing an intermediate point corresponding to one half of the height h of each of the rotary vanes 21 and a neighboring portion of the respective rotary vane 21 encompassed by ±0.1 h in the axial direction C from this intermediate point.

Also, during the rotation of the cooling fan assembly 10, the cooling air A then entering a space beneath the screen member 11 and above the cooling fan assembly 10 can be divided by the intermediate connecting plates 22 into two streams one flowing above the other as it is radially outwardly expelled. Each of the intermediate connecting plates 22 has a radial inner edge 22*a* set to a size larger by a predetermined dimension d than a radial outer edge 20*a* of the annular base plate 20 so that when viewed in a direction conforming to the axis of rotation C, the annular base plate 20 and the intermediate connecting plates 22 may not overlap one above the other. By so doing, the cooling fan assembly 10 can be formed by means of any known molding technique using a simple mold assembly including two molds one separable vertically relative to the other.

The flywheel 9, the cooling fan assembly 10 and the screen member 11 are secured to the crankshaft 1 in the manner which will now be described. Referring now to FIG. 1, at the outset, the flywheel 9 is fixedly mounted on the upper end 1*b* of the crankshaft 1 by means of a set bolt 24. Then, after the cooling fan assembly 10 is placed atop the flywheel 9, an annular metallic retainer plate 27 having screw insertion holes 27*a* defined therein is placed in part on the annular base plate 20 of the cooling fan assembly 10 and in part on the flywheel 9 to allow it to straddle between the annular base plate 20 and the flywheel 9. While the metallic retainer plate 27 has been so placed in the manner described above, screws 28*a*, each formed coaxially in a lower end of the respective support pillar 28, are successively threaded into corresponding screw holes 9*a* defined in the flywheel 9 through the associated insertion holes 27*a* in the retainer plate 27, thereby securing the cooling fan assembly 10 to the flywheel 9 while sandwiched between the retainer plate 27, then fixed in position through the three support pillars 28, and the flywheel 9.

In a condition after the cooling fan assembly 10 has been secured to the flywheel 9 in the manner described above, the support pillars 28 assume a position extending upwardly in parallel relation to the axis of rotation C. The screen member 11 is, after having been mounted atop the respective upper ends of the support pillars 28, secured to the support pillars 28 by means of set bolts 32 each threaded into associated screw holes 28*b*, defined in the upper end of the respective support pillar 28, through mounting holes 34 defined in the screen member 11. In this way, the screen member 11 is secured to the three support pillars 28 so as to overhang a region on the suction side of the cooling fan assembly 10.

As best shown in FIG. 3, the upright wall 30 of the guide body 23 extends radially outwardly and spirally from a trailing side of the longitudinal axis C2 of the second engine cylinder 3B with respect to the direction of rotation R of the crankshaft 1, terminating at a position closer to the longitudinal axis C1 of the first engine cylinder 3A than to a position generally intermediate between the first and second engine cylinders 3A and 3B.

On the other hand, the ceiling wall 31 continued perpendicularly from a lower edge of the upright wall 30 as viewed in FIG. 1 and spreading inside the spirality depicted by the upright wall 30 has a radial inner edge 31*a* which is so shaped as to follow a portion of the curvature of the cooling fan assembly 10 with a radial gap D of about 1 to 2 mm defined between the radial inner edge 31*a* and a radial outer edge 10*a* of the cooling fan assembly 10. Thus, it will readily be understood that the ceiling wall 31 has its width progressively increasing from the trailing side of the longitudinal axis C2 of the second engine cylinder 3B towards the leading side thereof or towards the trailing side of the longitudinal axis C1 of the first engine cylinder 3A with respect to the direction of rotation R. It is to be noted that the radial outer edge 10*a* of the cooling fan assembly 10 referred to above is intended to represents the imaginary circle depicted by radially outer side edges of the rotary vanes 21 in coaxial relation to the annular base plate 20.

The guide body 23 of the structure described above has a function of separating the cooling air A into streams of cooling air A11 and A21, as regulated by the upright and ceiling walls 30 and 31, which are supplied from inside of the spirality of the upright wall 30 towards the first engine cylinder 3A, and a stream of cooling air A22 which is supplied along a lower surface of the ceiling wall 31 towards the second engine cylinder 3B.

Figure 5:
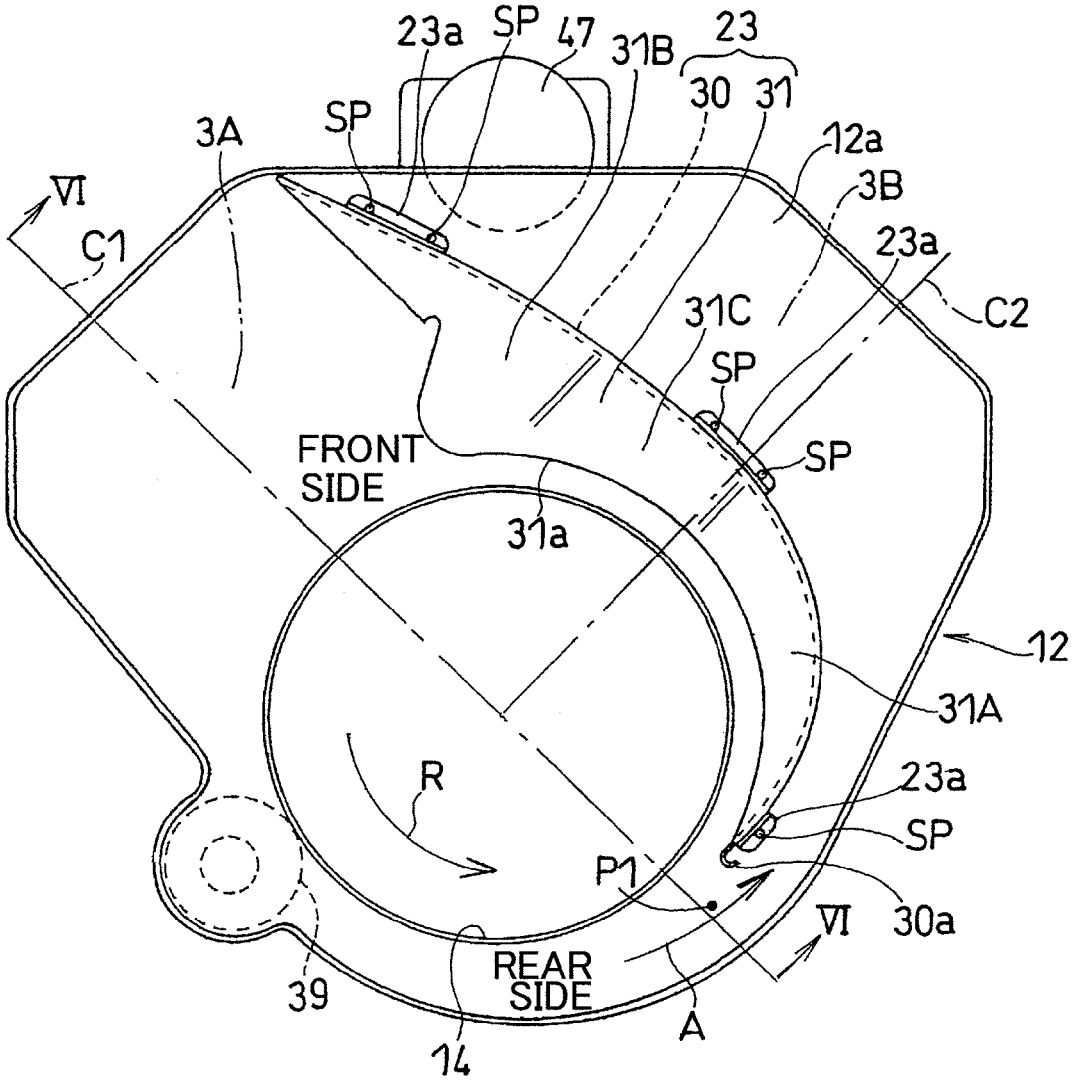
FIG. 5 is a schematic bottom plan view, showing a fan casing used in the air-cooled V-type combustion engine.
Figure 6:
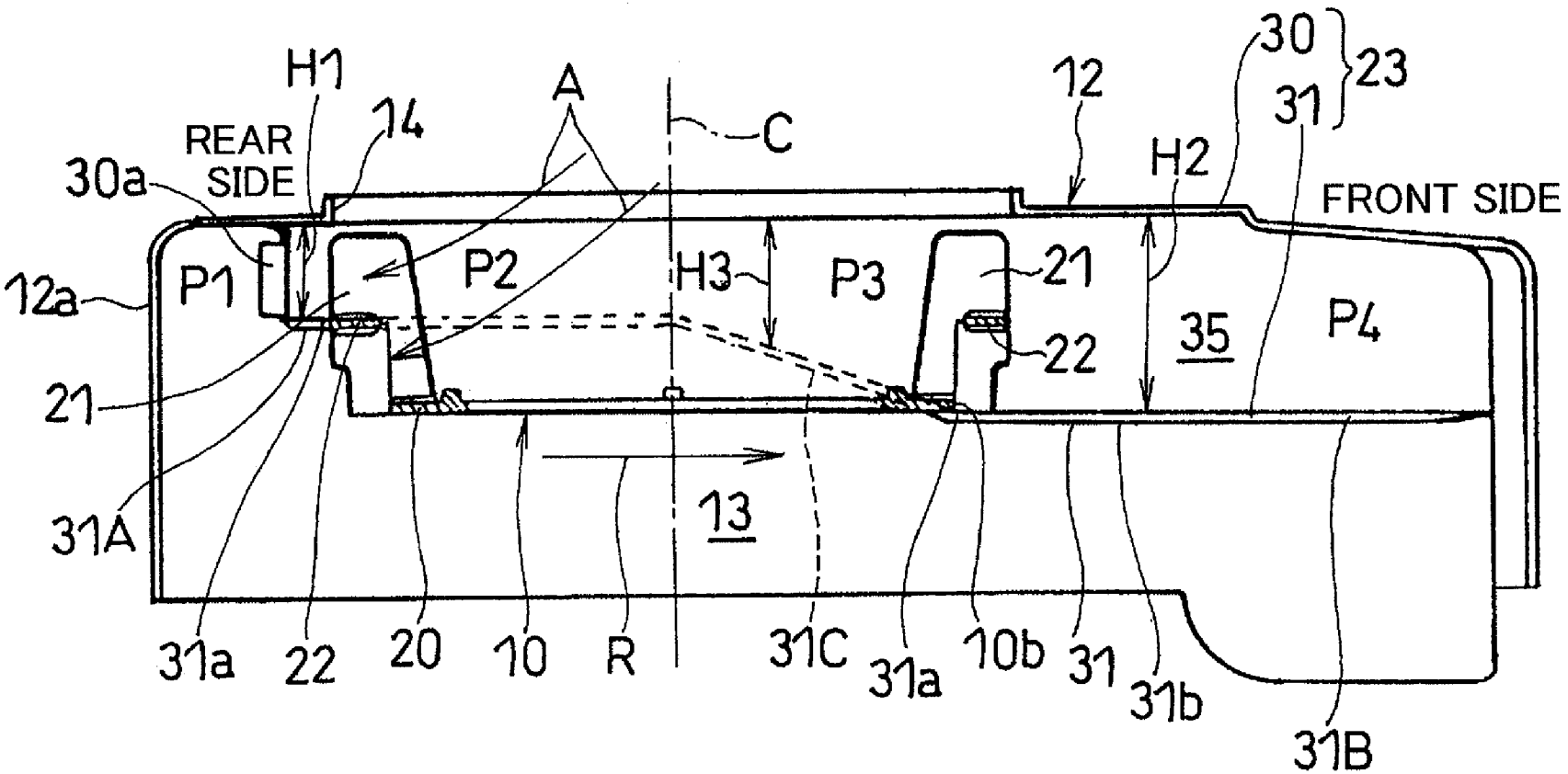
FIG. 6 is a cross-sectional view taken along the line VI-VI in FIG. 5.

FIG. 5 illustrates, in a schematic bottom plan view, the fan casing 12 including the guide body 23 and FIG. 6 is a cross-sectional view taken along the line VI-VI in FIG. 5. As shown in FIG. 5, the radial inner edge 31*a* of the ceiling wall 31 of the guide body 23 forms an arch coaxial with the circular air intake opening 14 in the fan casing 12. The guide body 23 is secured to an inner surface of the casing body 12*a* of the fan casing 12 by the use of any known welding technique such as, for example, a spot welding technique forming spot weld deposits SP applied to mounting lugs 23*a*, which are provided at a root portion or an upper edge of the upright wall 30.

A trailing end of the upright wall 30 with respect to the direction of rotation R of the cooling fan assembly 10 is provided with a front guide member 30*a* of a shape bent radially outwardly relative to the air intake opening 14. This front guide member 30*a* serves to guide the cooling air A induced by the cooling fan assembly 10 to smoothly flow towards outside of the spirality of the upright wall 30.

As best shown in FIG. 6, the axial position of the ceiling wall 31 of the guide body 23 is offset at the trailing side (left as viewed in FIG. 6) with respect to the direction of rotation of the cooling fan assembly 10 to the fan casing 12 rather than to the leading side (right as viewed in FIG. 6) thereof, that is, outwardly of the axis of rotation C. In other words, the ceiling wall 31 is made up of a first flat wall area 31A defining a trailing portion with respect to the direction of rotation R, a second flat wall area 31B defining a leading portion with respect to the direction of rotation R, and an inclined wall area 31C connecting between the first and second flat wall areas 31A and 31B. In the illustrated embodiment, the height H1 of the first flat wall area 31A as measured between it and the inner surface of the fan casing 12 at a portion adjacent the air intake opening 14 is chosen to be smaller than the height H2 of the second flat wall area 31B as measured between it and such inner surface of the fan casing 12. The height H3 of the inclined wall area 31C as measured between it and such inner surface decreases substantially linearly from the height H1 down to the height H2.

A portion of the radial inner edge 31*a* of the ceiling wall 31, which is encompassed within the first flat wall area 31A, occupies an axial position aligned with a portion of each of the rotary vanes 21 intermediate of the length thereof and, hence, at an axial position level with the intermediate connecting plates 22 in the illustrated embodiment, whereas a portion of the radial inner edge 31*a* of the ceiling wall 31, which is encompassed within the second flat wall area 31B, occupies an axial position level with the inner and portion 10*b* of the cooling fan assembly 10. Since the first and second flat wall areas 31A and 31B and the inclined wall area 31C lie substantially perpendicular to the axial direction, the axial position of the first flat wall area 31A in its entirety is level with the intermediate connecting plate 22 of the cooling fan assembly 10 and the axial position of the second flat wall area 31B in its entirety is substantially level with an inner end portion 10*b* which is an axially lower end portion of the cooling fan assembly 10. As best shown in FIG. 5, each of the first flat wall area 31A, the second flat wall area 31B and the inclined wall area 31C has a length that is about one third of the total length of the upright wall 30 along the curved upright wall 30.

In the construction described hereinabove, when the air-cooled V-type combustion engine E is started by the starter motor 39 accompanied by rotation of the crankshaft 1 in one direction R, the flywheel 9, the cooling fan assembly 10 and the screen member 11 rotate together with the crankshaft 11 and, accordingly, by the effect of a suction force induced by the cooling fan assembly 10, air from the outside can be sucked into the casing body 12*a* through the air intake slits 38 of the covering 12*b* and then through the screen member 11 positioned at the air intake opening 14. The air so sucked into the casing body 12*a* in the manner described above forms a current of cooling air A, which is then supplied through the cooling air passage 13, defined inside the casing body 12*a*, towards the engine body EB including the first and second engine cylinders 3A and 3B, the cylinder heads 7A and 7B and the crankcase 2. After the current of cooling air A has been used to cool the engine body BE, the current of cooling air A can be discharged to the outside.

Figure 7A:
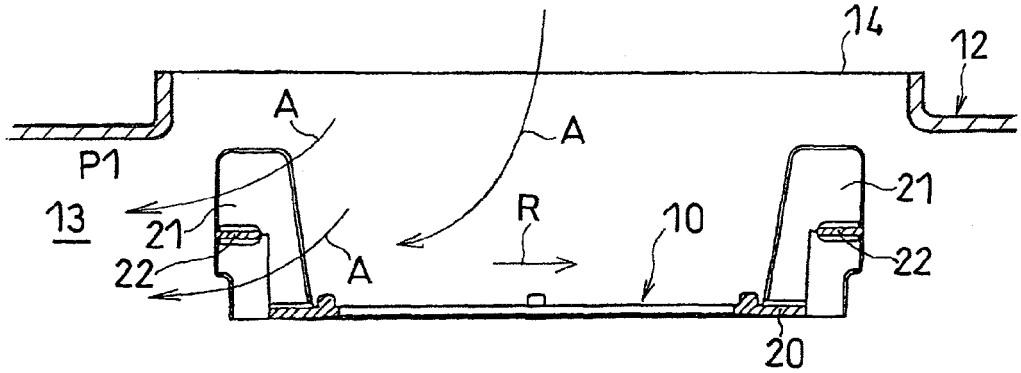
FIGS. 7A to 7D are schematic sectional views, showing the manner of distribution of the cooling air at different locations of a guide body employed in the air-cooled V-type combustion engine, respectively.

Hereinafter, the function of the guide body 23 to distribute the cooling air A towards the two engine cylinders 3A and 3B will now be described with particular reference to FIGS. 3 and 7. In a first region P1 defined on a trailing side of the trailing end of the guide body 23 with respect to the direction of rotation R of the cooling fan assembly 10 as shown in FIG. 3, the cooling air A induced by the cooling fan assembly 10 flows towards the cooling air passage 13 defined within the fan casing 12 since the guide body 23 does not exist there as shown in FIG. 7A. This cooling air A is subsequently guided towards the second engine cylinder 3B after having past the outside of the spirality of the upright wall 30 while flowing along the inner surface of the fan casing 12.

Figure 7B:
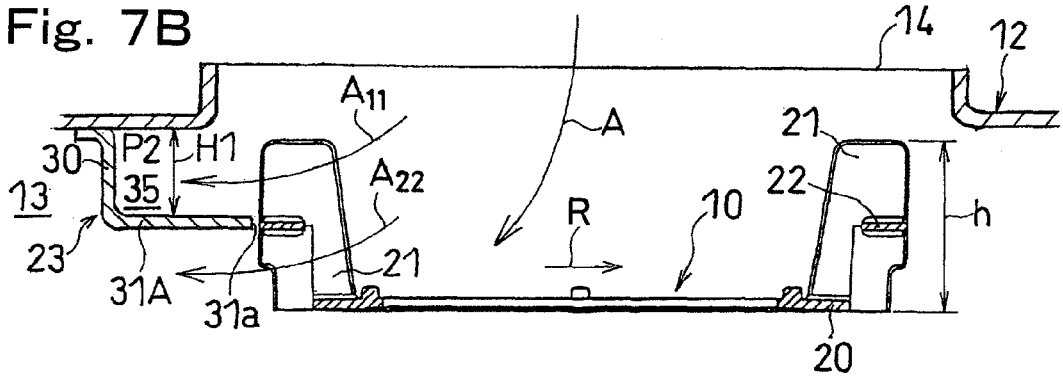

In a second region P2 defined so as to confront the first flat wall area 31A of the ceiling wall 31 of the guide body 23, as shown in FIG. 7B, since the intermediate connecting plates 22 of the cooling fan assembly 10 are held at a position level with the axial position of the radial inner edge 31*a* of the first flat wall area 31A, a stream of cooling air A22 flowing below the intermediate connecting plates 22 of the cooling fan assembly 10 is allowed to flow below the first flat wall area 31A and, on the other hand, a stream of cooling air A11 flowing above the intermediate connecting plate 22 of the cooling fan assembly 10 is allowed to flow above the first flat wall area 31A.

Accordingly, as shown in FIG. 3, the stream of cooling air A22 flowing below the first flat wall area 31A is in no way regulated by the guide body 23 and is therefore guided straight towards the second engine cylinder 3B. On the other hand, the stream of cooling air A11 flowing above the intermediate connecting plates 22 shown in FIG. 7B is guided towards the first engine cylinder 3A shown in FIG. 3 after having flown through an air guide passage 35 that is bound by the upper surface (inner surface) of the first flat wall area 31A, the inner surface of the spirality of the upright wall 30 and the inner surface of the fan casing 12. At this time, axial and radial flows of the stream of cooling air A11 are regulated by the ceiling wall 31 and the upright wall 30, respectively, and, accordingly, the stream of cooling air A11 can be guided in an amount as supplied from the cooling fan assembly 10 towards the first engine cylinder 3A.

Figure 7C:
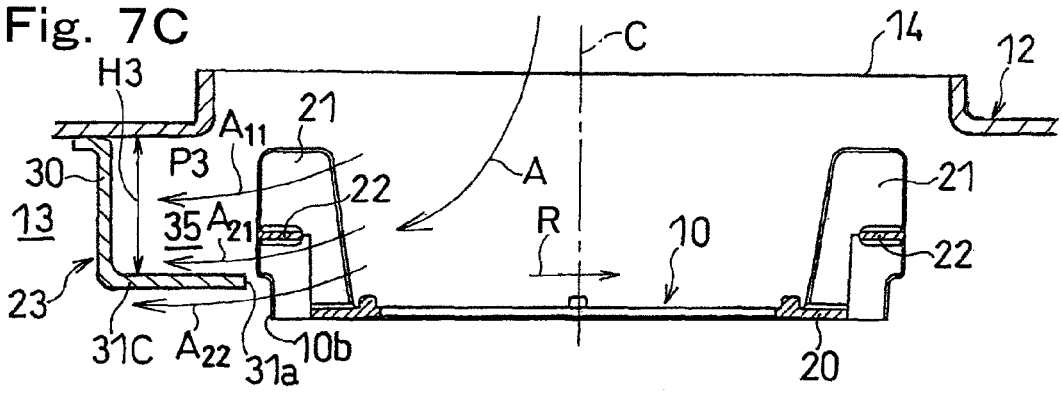

In a third region P3 defined so as to confront the inclined wall area 31C of the ceiling wall 31 of the guide body 23, as shown in FIG. 7C, since the radial inner edge 31*a* of the inclined wall area 31C is positioned intermediate between the intermediate connecting plates 22 of the cooling fan assembly 10 and the inner end portion 10*b* thereof, a stream A21 of the cooling air A flowing below the intermediate connecting plates 22 of the cooling fan assembly 10 flows into the air guide passage 35 after having flown above the inclined wall area 31C and a stream A22 of the cooling air A flows into the cooling air passage 13 after having flown below the inclined wall area 31C. In view of the fact that the inclined wall area 31C is progressively inclined downwardly to a lower position along the direction of rotation R, the amount of the cooling air stream A21 of the cooling air A gradually increases as it flows in a direction conforming to the direction of rotation R while the amount of the cooling air stream A22 gradually decreases. In other words, the flow of the cooling air streams A11 and A21 of the cooling air A that are supplied towards the first engine cylinder 3A shown in FIG. 3 gradually increase, but the flow of the cooling air stream A22 of the cooling air A that is supplied towards the second engine cylinder 3B gradually decreases.

Figure 7D:
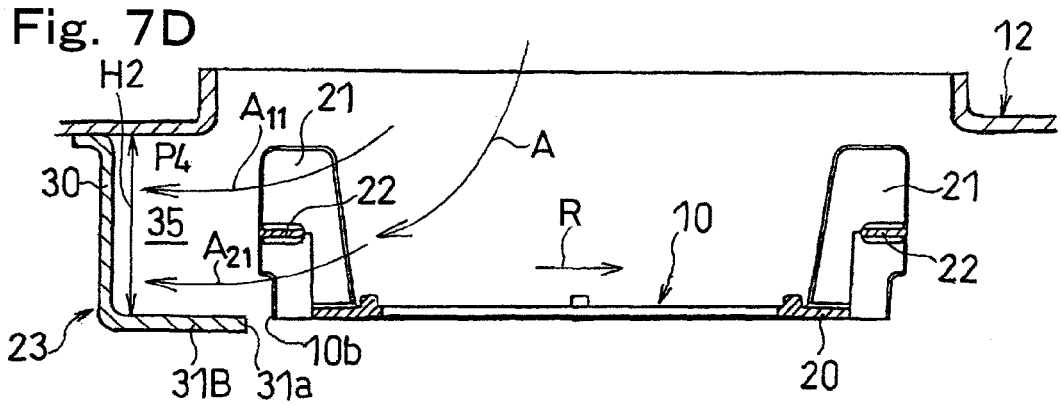

As shown in FIG. 7D, In a fourth region P4 defined so as to confront the second flat wall area 31B of the ceiling wall 31, since the radial inner edge 31*a* of the second flat wall area 31B is held in proximity of the inner end portion 10*b* of the cooling fan assembly 10, the cooling air stream A11 flowing above the intermediate connecting plates 22 and the cooling air stream A21 flowing below the intermediate connecting plates 22 enter the air guide passage 35 bound by the ceiling wall 31, the upright wall 30 and the inner surface of the fan casing 12 and are then guided from the air flow guide passage 35 towards the first engine cylinder 3A shown in FIG. 3. At this time, the cooling air streams A11 and A21 are guided towards the first engine cylinder 3A in an amount as supplied from the cooling fan assembly 10, in a manner substantially similar to that described above with respect to FIG. 7B.

Conventionally, the amount of the cooling air A supplied towards the first engine cylinder 3A used to tend to be insufficient since it is positioned on the leading side with respect to the direction of rotation R of the cooling fan assembly 10. In the air-cooled V-type combustion engine E of the structure described hereinabove, since the cooling air A can be supplied towards the first engine cylinder 3A through the air guide passage 35 bound by the respective inner surfaces of the upright wall 30, ceiling wall 31 and fan casing 12, it is possible to supply a required amount of the cooling air while leakage of the cooling air A is suppressed by the ceiling wall 31.

In addition, since the radial inner edge 31*a* of the ceiling wall 31 is positioned in proximity of the radial outer edge 10*a* of the cooling fan assembly 10 with the extremely small radial gap D of about 1 to 2 mm intervening between the radial inner edge 31*a* and the radial outer edge 10*a*, an undesirable leakage of the cooling air A from between the cooling fan assembly 10 and the ceiling wall 31 can be suppressed and, therefore, it is possible to secure a sufficient amount of cooling air required to cool the first engine cylinder 3A.

As described above with reference to FIG. 6, the guide body 23 is so designed and so configured that the ceiling wall 31 has a height increasing stepwise from the trailing side to the leading side with respect to the direction of rotation R of the cooling fan assembly 10, that is, the ceiling wall 31 has a vertical position lowering stepwise in the case of the vertical combustion engine. With this construction the amount of the cooling air A to be supplied towards the second combustion engine 3B can be gradually reduced from a condition in which the entire amount of the cooling air A is supplied towards the second combustion cylinder 3B shown in FIG. 3 and the amount of the cooling air A to be supplied towards the first combustion engine 3A can be gradually increased by a quantity corresponding to the amount so reduced, finally allowing the substantially entire amount of the cooling air C to be supplied towards the first engine cylinder 3A. Accordingly, the proportion of the cooling air A to be distributed towards the two engine cylinders 3A and 3B varies smoothly stepwise. Hence, by suitably setting the size and the location of the guide body 23, it is possible to supply the cooling air A in a substantially equal amount and in a desired proportion towards the first and second engine cylinders 3A and 3B. Accordingly, the first and second engine cylinders 3A and 3B can be effectively cooled.

As hereinbefore described, the intermediate connecting plates 22 each circumferentially connecting the neighboring rotary vanes 21 together are arranged at a location axially intermediate of the cooling fan assembly 10 shown in FIG. 6, and the radial inner edge 31*a* of the first flat wall area 31A, which is a trailing portion of the ceiling wall 31 of the guide body 23, is set to the substantially same axial position as the intermediate connecting plates 22. Accordingly, during the rotation of the cooling fan assembly 10, the cooling air A can be induced as divided by the intermediate connecting plates 22 into two streams of cooling air and, in the trailing side of the ceiling wall 31, the cooling air A induced axially inwardly (below) of the intermediate connecting plates 22 can smoothly flow around the second engine cylinder 3B without being regulated by the upright wall 30 and the ceiling wall 31 and, on the other hand, the cooling air A induced axially outwardly (above) of the intermediate connecting plates 22 can be guided towards the first engine cylinder 3A after having been regulated by the upright wall 30 and the ceiling wall 31. Accordingly, it is possible to minimize the cooling air A from being ruffled by the ceiling wall 31 and, therefore, the sufficient amount of cooling air to be supplied towards the engine cylinders 3A and 3B can be secured advantageously.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. By way of example, in the foregoing embodiment, each of the fan casing 12 and the guide body 23 may be made of resinous material. In such case, the guide body 23 is, for example, bonded to the fan casing 12.

Also, although in the foregoing embodiment, the present invention has been shown and described as applied to the vertical V-twin combustion engine, the present invention can be equally applied to a vertical V-quad combustion engine, in which the V arrangement of two engine cylinders are deployed in two stages, or a transverse air-cooled V-type combustion engine, in which the crankshaft is laid horizontally. In addition, the present invention can be applied not only to the brush cutting machine referred to in the foregoing description, but also to any agricultural machine such as, for example, a combine.

Accordingly, such changes and modifications are, unless they depart from the scope of the present invention as delivered from the claims annexed hereto, to be construed as included therein.

What is claimed is:

1. An air-cooled V-type combustion engine comprising:

at least first and second engine cylinders positioned on leading and trailing sides with respect to a direction of rotation of a cooling fan assembly, respectively;

a fan casing accommodating therein the cooling fan assembly, which is drivingly coupled with a rotary shaft of the combustion engine and operable to induce a cooling air for cooling the first and second engine cylinders; and a guide body for dividing the cooling air discharged from the cooling fan assembly, into first and second separate cooling air streams to cool the first and second engine cylinders, respectively:

wherein the guide body comprises:

an upright wall positioned on an inner surface of the fan casing and protruding in a direction parallel to an axis of rotation of the cooling fan assembly and extending radially outwardly and spirally from a trailing side towards a leading side with respect to the direction of rotation of the cooling fan assembly; and a ceiling wall connected with a projecting end of the upright wall and extending spirally inwardly so as to guide the first cooling air stream, then flowing inside of spirality of the upright wall, towards the first engine cylinder, while forming a cooling air passage between the inner surface of the fan casing and an outer surface of the guide body to provide the second cooling air stream through the second engine cylinder.

2. The air-cooled V-type combustion engine as claimed in claim 1, wherein an axial position of the ceiling wall is offset at a trailing side with respect to a direction of rotation of the cooling fan assembly closer to the fan casing rather than at the leading side thereof.

3. The air-cooled V-type combustion engine as claimed in claim 2, wherein a radial inner edge of a trailing portion of the ceiling wall is set to an axial position aligned with an axially intermediate point of rotary vanes of the cooling fan assembly.

4. The air-cooled V-type combustion engine as claimed in claim 3, wherein the cooling fan assembly includes intermediate connecting plates each connecting the neighboring rotary vanes together in a circumferential direction and the radial inner edge of the trailing portion of the ceiling wall is set to the substantially same axial position as that of the intermediate connecting plates.

5. The air-cooled V-type combustion engine as claimed in claim 2, wherein the ceiling wall includes a first flat wall area forming the trailing portion thereof, a second flat wall area forming the leading portion, and an inclined wall area connecting the first and second flat wall areas together.

6. The air-cooled V-type combustion engine as claimed in claim 5, wherein each of the first and second flat wall areas extends in a direction substantially perpendicular to an axial direction of the cooling fan assembly.

7. The air-cooled V-type combustion engine as claimed in claim 2, wherein a radial inner edge of the leading portion of the ceiling wall is held in proximity of an axial inner end portion of the cooling fan assembly.

8. The air-cooled V-type combustion engine as claimed in claim 1, wherein a radial inner edge of the ceiling wall is held in proximity of a radial outer edge of the cooling fan assembly.

9. The air-cooled V-type combustion engine as claimed in claim 8, wherein the radial inner edge of the ceiling wall and the radial outer edge of the cooling fan assembly are spaced by a radial gap of 1 to 2 mm.

10. The air-cooled V-type combustion engine as claimed in claim 1, wherein the upright wall extends from a trailing side of a longitudinal axis of the second engine cylinder with respect to the direction of rotation to a position closer to a longitudinal axis of the first engine cylinder than to a position intermediate between the first and second engine cylinders in a direction conforming to the direction of rotation.

11. An air-cooled V-type combustion engine comprising:

at least first and second engine cylinders positioned on leading and trailing sides with respect to a direction of rotation of a cooling fan assembly, respectively;

a fan casing accommodating therein the cooling fan assembly, which is drivingly coupled with a rotary shaft of the combustion engine and operable to induce a cooling air for cooling the first and second engine cylinders; and a guide body for dividing the cooling air discharged from the cooling fan assembly, into first and second separate cooling air streams to cool the first and second engine cylinders, respectively:

wherein the guide body comprises:

an upright wall positioned on an inner surface of the fan casing and protruding in a direction parallel to an axis of rotation of the cooling fan assembly and extending radially outwardly and spirally from a trailing side towards a leading side with respect to the direction of rotation of the cooling fan assembly; and a ceiling wall connected with a projecting end of the upright wall and extending spirally inwardly so as to guide the first cooling air stream, then flowing inside of spirality of the upright wall, towards the first engine cylinder, while forming a cooling air passage between the inner surface of the fan casing and an outer surface of the guide body to provide the second cooling air stream through the second engine cylinder;

wherein the guide body progressively directs a greater volume of air into first cooling air stream as the guide body upright wall extends radially outward and spirally away from the rotary shaft of the combustion engine.

12. An air-cooled V-type combustion engine comprising:

at least first and second engine cylinders positioned on leading and trailing sides with respect to a direction of rotation of a cooling fan assembly, respectively, the cooling fan assembly including a plurality of rotary vanes and a screen member mounted above the rotary vanes to prevent debris larger than screen perforations from entering and contacting the rotary vanes, wherein the screen member rotates with the rotary vanes;

a fan casing accommodating therein the cooling fan assembly, which is drivingly coupled with a rotary shaft of the combustion engine and operable to suck air into the fan casing through the screen member and to induce a cooling air for cooling the first and second engine cylinders; and a guide body for dividing the cooling air discharged from the cooling fan assembly, into first and second separate cooling air streams to cool the first and second engine cylinders, respectively;

wherein the guide body comprises:

an upright wall positioned on an inner surface of the fan casing and protruding in a direction parallel to an axis of rotation of the cooling fan assembly and extending radially outwardly and spirally from a trailing side towards a leading side with respect to the direction of rotation of the cooling fan assembly; and a ceiling wall connected with a projecting end of the upright wall and extending spirally inwardly so as to guide the first cooling air stream, then flowing inside of spirality of the upright wall, towards the first engine cylinder, while forming a cooling air passage between the inner surface of the fan casing and an outer surface of the guide body to provide the second cooling air stream through the second engine cylinder.

* * * * *